US006629824B2

(12) United States Patent
Yamauchi

(10) Patent No.: US 6,629,824 B2
(45) Date of Patent: Oct. 7, 2003

(54) VACUUM PUMP

(75) Inventor: Akira Yamauchi, Chiba (JP)

(73) Assignee: Seiko Instruments Inc. (JP)

( * ) Notice: Subject to any disclaimer, the term of this patent is extended or adjusted under 35 U.S.C. 154(b) by 236 days.

(21) Appl. No.: 09/915,595

(22) Filed: Jul. 26, 2001

(65) Prior Publication Data

US 2002/0018727 A1 Feb. 14, 2002

(30) Foreign Application Priority Data

Jul. 31, 2000 (JP) ..... 2000-231768

(51) Int. Cl.[7] ..... F04B 23/00
(52) U.S. Cl. ..... 417/313
(58) Field of Search ..... 417/313, 53, 222.2, 417/312, 553; 415/90, 72, 73, 75; 123/572, 557

(56) References Cited

U.S. PATENT DOCUMENTS 4,904,155 A * 2/1990 Nagaoka et al. ..... 415/90
5,577,883 A 11/1996 Schuetz et al.
5,618,167 A * 4/1997 Hirakawa et al. ..... 417/372
5,919,339 A * 7/1999 Ikeda ..... 202/238
5,924,841 A 7/1999 Okamura et al.
6,193,461 B1 * 2/2001 Hablanian ..... 415/90
6,253,029 B1 * 6/2001 Hayashi et al. ..... 392/471
6,382,249 B1 * 5/2002 Kawasaki et al. ..... 137/565.3
6,416,290 B1 * 7/2002 Yamauchi ..... 417/32
6,503,050 B2 * 1/2003 Reimer et al. ..... 415/90

FOREIGN PATENT DOCUMENTS

EP 0299458 1/1989
EP 0451708 10/1991
EP 0855517 7/1998

OTHER PUBLICATIONS

Patent Abstracts of Japan, vol. 016, No. 458 (M–1315) Sep. 24, 1992 & JP 04164187 A (Shimadzu corp), Jun. 9, 1992.
Patent Abstracts of Japan, vol. 016, No. 127 (M–1227) Mar. 31, 1992 & JP 03290092 A (Shimadzu corp), Dec. 19, 1991.

* cited by examiner

*Primary Examiner*—Teresa Walberg
*Assistant Examiner*—Vinod D. Patel
(74) *Attorney, Agent, or Firm*—Adams & Wilks

(57) ABSTRACT

To provide a vacuum pump that may heat a flow path of gas effectively with small electric power. A vacuum pump provided with an outer sleeve, a stator received in a hollow portion of the outer sleeve, a rotor received rotatably within the hollow portion of the outer sleeve for forming a flow path of gas in cooperation with the stator, a base to which the outer sleeve and the stator are to be fixed and supported, a heating electromagnet for generating heat by current supply and forming a magnetic field, a magnetic member forming a magnetic path of magnetic force by the heating electromagnet, and a heat radiation plate made of aluminum and fixed to the magnetic member.

9 Claims, 10 Drawing Sheets

Prior Art

Prior Art

VACUUM PUMP

BACKGROUND OF THE INVENTION

1. Field of the Invention

The present invention relates to a vacuum pump that may avoid precipitate of gas molecular composition by heating a discharge path of gas effectively with a small amount of electrical power and is superior in handling property and safety aspect in low cost.

2. Description of the Related Art

Conventionally, a vacuum pump such as a turbo molecular pump or a screw groove type pump is well known. Such a vacuum pump has been extensively used for analysis and measurement utilizing electronic rays or in the case where a vacuum process such as a dry etching process or a CVD through a semiconductor manufacturing apparatus or a liquid crystal manufacturing process is performed by discharging process gas within the chamber.

In such a vacuum pump, a stator portion and a rotor portion are received in an outer sleeve portion having a hollow portion, and a flow path of gas is formed by means of the stator portion and the rotor portion. Then, the rotor portion is rotated by means of a motor to thereby move the gas of the flow path so as to suck the gas from the outside through an intake port.

Such a vacuum pump is a turbo molecular pump in which a plurality of spacers are arranged coaxially with the rotor portion, stator blades projecting toward the rotor portion are arranged between the spacers and rotor blades projecting between the stator blades are arranged in the rotor portion. In this turbo molecular pump, gas molecular is struck to be transferred by the rotation of the rotor blades.

In another example, a screw groove is formed in one of circumferential surfaces, facing each other, of the rotor portion and the stator portion, and a screw groove type vacuum pump for transferring the gas utilizing viscosity of the gas by the rotation of the rotor is used in combination with the turbo molecular pump. This is usually used in a semiconductor manufacturing apparatus or the like.

By the way, in the above-described vacuum pump, a pressure is low on the intake port side upon the suction of gas and a pressure is kept high on the discharge port side. Also, in order to prevent the excessive heating due to the provision of electronic equipments such as motors arranged in the central portion, the interior of the vacuum pump is kept at a temperature not higher than a predetermined temperature by means of a cooling means for recirculating water.

For this reason, in the case where reactive gas such as AlCl3 or the like being process gas is to be sucked in an etching process in the case where the pump is used in the semiconductor manufacturing apparatus, in some cases, the gas is precipitated by the sublimation of gas to be transferred in the vicinity of the discharge port to stick to the surface of the flow path.

Then, due to this deposition, there is a possibility that the flow of gas is prevented, the transfer efficiency of gas by the vacuum pump becomes low, or in the worst case, the depositions adhered to the rotor portion and the stator portion are brought into contact with each other to cause the damage of the members.

In the vacuum pump, as a technology for avoiding the precipitation due to the sublimation of the reactive gas by heating the flow path of gas, there is a conventional technology for arranging a heater using a nichrome line around the lower portion of the vacuum pump.

FIG. 9 is a schematic view representing an overview structure of the vacuum pump adopting such a technology.

The conventional vacuum pump shown in FIG. 9 is a composite pump. A stator portion 118 and a rotor portion 114 are received in an outer sleeve portion 116 having a hollow portion. The outer sleeve portion 116 and the stator portion 118 are fixed and supported onto a base 119. The rotor portion 114 is supported rotatably coaxially to the stator portion 118 on the base 119. Rotor blades 1141 projecting in a radial direction of rotation at one end in an axial direction are provided in a plurality of stages in the axial direction of rotation. The stator portion 118 is provided with a plurality of stator blades 1181 projecting from an outer side of the rotor portion 114 between the rotor blades 1141, and is provided with groove provided spacers 1180 surrounding the outer circumferential surface of the rotor portion 114 in the vicinity thereof at the other end of the axial direction.

Also, a temperature sensor 151 for detecting the temperature in the vicinity of the flow path of the gas is provided in the vicinity of the base 119. Also, a water-cooling pipe 171 is in contact with the bottom surface of the base 119. The water-cooling pipe 171 is adapted to be opened and closed by means of an electromagnetic valve 172. Furthermore, a nichrome heater 160 is wound around the outer circumferential surface of the base 119.

Then, the rotor portion 114 is rotated relative to the stator portion 118 by a motor disposed in the substantially center of the vacuum pump. The gas molecular is stuck down by means of the rotor blades 1141 and the stator blades 1181 on the side of the above-described end. On the other end side, the viscous flow of the gas molecular stuck down is formed in the groove provided spacers 1180 to transfer the gas molecular to the discharge port by the viscosity. Thus, the gas from the opening portion (suction port) on one end side of the outer sleeve portion 116 is discharged from the discharge port formed in the base 119 through the flow path of gas formed between the rotor portion 114 and the stator portion 118.

In this vacuum pump, as shown in FIG. 10, a decision is made as to whether a heater 160 and an electromagnetic valve 172 is turned on or off on a judgement device 185 on the basis of a set temperature Td set in advance and a temperature Tr detected from the temperature sensor 151 by means of a controller 180 on the basis of the output from a temperature sensor 151. Namely, if $Tr<Td$, the heater 160 is turned on to heat the gas flow path, and the electromagnetic valve 172 is turned off to thereby stop the flow of water through the water-cooling pipe 171. Also, in the case where $Tr \geqq Td$, the electromagnetic valve 172 is turned on so that the flow of water through the water-cooling pipe 171 is recirculated. The heater 160 is turned off so that the gas flow path is cooled down. Then, the flow path of gas is kept in the predetermined temperature range by means of the elevation of temperature by the heater 160 and the cooling-effect by the flow of water through the water-cooling pipe 171. Thus, the precipitation due to the sublimation of the reactive gas is controlled.

Also, as a technology for avoiding the precipitation of the gas composition in the vicinity of the discharge port, there is a proposal of the technology to heat the flow path of gas by providing an alternative current to a coil using magnetic material as a core (Japanese Utility Model Registration No. 2570575).

According to the technology, the flow path of gas is heated by means of the heat generation of the magnetic hysteresis and the heat generation within the core due to the eddy current by embedding a coil using the magnetic material as a core into the base supporting the outer sleeve and having the discharge port to feed alternating current to the coil.

However, in the vacuum pump using the heater shown in FIG. 9, the heating of the vicinity of the discharge port is performed only by means of the nichrome line heater 160. Accordingly, it is necessary to use a large capacity heater 160 at about 300 W. For this reason, there is a problem that a large load is applied to the controller power source, it is difficult to handle the vacuum pump since it is necessary to use a cable having a greater diameter, or the manufacturing cost and the running cost are high.

Also, in order to provide the heater 160 on the surface of the vacuum pump and heat the flow path of gas from the outside, the heat is likely to escape to the outside and it is impossible to give Joule's heat effectively to the portion to be heated. Thus, there is a problem that a further large electric power is needed. Incidentally, in order to ensure the safety aspect, a method for covering the heater 160 by silicone rubber or the like is adopted, however, which leads to such a problem in that the manufacturing cost is further increased, the size is increased due to the necessity to provide the protection function such as thermostat or the like or the manufacturing cost is further increased.

Furthermore, in the vacuum pump using the heater shown in FIG. 5, it takes long time to cool down the nichrome line after the heater 160 is turned off, and the followability of temperature control is not good.

In the technology for feeding the alternating current to the coil having a core made of magnetic material and heating the flow path of gas, since the heat is generated by the magnetic hysteresis and the flow path of gas is heated from the vacuum pump interior portion by utilizing the heat generation due to the eddy current, it is possible to effectively utilize the heat generation with safety in comparison with the vacuum pump using the heater as shown in FIG. 5. However, it takes a structure in which the coil is embedded in the interior of the base of the pump, the excited heat is absorbed in the base, and it is difficult to elevate the temperature of the flow path portion only. Also, since the strong alternating magnetic field is generated in the interior of the vacuum pump, for example, in the case where a position sensor or the like for detecting the delicate change of the magnetic field in terms of the inductance change of the coil, the alternating magnetic field would adversely affect as noise, and in particular, in the magnetic bearing type vacuum pump, the adverse affect might be remarkable.

SUMMARY OF THE INVENTION

In order to solve the above-described problems, a first object of the present invention is to provide a less expensive pump that may avoid the precipitation of the gas molecular composition in a flow path of gas by heating the flow path of gas effectively with a small electric power. Also, in addition to the first object, a second object of the present invention is to provide a vacuum pump that is superior in handing property and safety aspect.

In order to attain the first object, according to the present invention, there is provided a vacuum pump (first structure) comprising: an outer sleeve portion; a stator portion received in a hollow portion of the outer sleeve portion; a rotor portion received rotatably relative to the stator portion within the hollow portion of the outer sleeve portion for forming a flow path of gas in cooperation with the stator portion; a motor for rotating the rotor portion and for moving the gas within the flow path; a base portion having a discharge path for discharging the gas from the flow path to the outside for supporting the stator portion; a heating electromagnet arranged in the vicinity of the discharge path; a magnetic member for forming a magnetic path of magnetic force by the heating electromagnet arranged in the vicinity of the discharge path; and a control means for controlling current supply to the heating electromagnet.

In the vacuum pump with the first structure of the present invention, when the heating electromagnet is subjected to the current supply by the control means, the coil of the heating electromagnet is heated. Also, the magnetic path of magnetic force by the heating electromagnet is formed through the magnetic member so that the magnetic affect by the heating electromagnet will no longer occur. Then, since the magnetic member is in intimate contact with the heating electromagnet, the heat generated within the coil of the heating electromagnet is rapidly transferred to the magnetic member. The magnetic member may quickly heat the gas because the member is provided within the flow path of gas.

Thus, in the vacuum pump with the first structure of the present invention, when the heating electromagnet is arranged in the vicinity of the discharge path of gas, furthermore, the magnetic member is brought into intimate contact with the heating electromagnet so as to form a magnetic path of magnetic force of this heating electromagnet and the heating electromagnet is subjected to the current supply, the Joule's heat generated in the coil of the electromagnet is effectively transferred to the magnetic member. As a result, it is possible to heat the discharge path and effectively suppress the precipitation due to the sublimation of the reactive gas with a less electric power. In this case, the magnetic member may be formed integrally with the heating electromagnet. Then, since the electric power may be suppressed less, it is possible to reduce the load imposed on the control power source, to dispense with a thick cable, to easily handle, and to reduce the manufacturing cost or running cost.

The above-described heating electromagnet is arranged in the vicinity of the discharge path. This discharge path vicinity means the vicinity of the rotor portion and the stator portion out of the joint portion of the discharge path formed in the base with the gas flow path formed by the rotor portion and the stator portion and the discharge path formed in the base. The pressure is relatively high in the vicinity of the discharge path and the precipitation due to the sublimation of the reactive gas is likely to occur. However, according to this structure, it is possible to positively prevent the precipitation due to the sublimation of the reactive gas in this portion. Then, it is possible to prevent the degradation of the discharge function due to the prevention of the gas flow and the contact between the rotor portion and the precipitated material. Also, the current to be fed to the heating electromagnet may be a d.c. current to thereby avoid the generation of the noise due to the alternating magnetic field.

The above-described stator portion and the above-described base or the above-described outer sleeve portion and the base may be formed as the discrete members at the beginning and fixed together later, or formed integrally together from the origin.

Also, in the vacuum pump with the first structure according to the present invention, there is provided the vacuum pump (second structure) in which the heating electromagnet and the magnetic member face each other through a gap. Thus, the gap is provided between the heating electromagnet and the magnetic member whereby the temperature control of the gas flow path may be performed by the high responsibility of the Joule's heat generated by the heating electromagnet coil.

Furthermore, according to the present invention, there is provided a vacuum pump (third structure) in the foregoing first and second structure, in which the heating electromagnet is fixed to one of the base portion and the stator portion through a heat insulating portion for reducing heat conduction between the heating electromagnet and the one.

In the vacuum pump of the third structure, since the heating electromagnet surrounding the coil heated by the copper loss upon current supply is thermally insulated from the pump body having a large thermal capacitance by the thermal insulating portion, it is possible to prevent the generated heat of the coil from escaping except for the discharge path and to further effectively heat the discharge path.

As the above-described thermal insulating portion, it is possible to recommend to use a member made of heat insulating material disposed between the heating electromagnet and the one, a member in which a pillar-like member having a small thermal capacity is disposed only in a portion out of the interval between the heating electromagnet and the one.

According to the present invention, in the first, second and third structures, there is provided a vacuum pump (fourth structure) further comprising a heat transfer means for transferring heat generated from the heating electromagnet to the discharge path and the vacuum pump is fixed and arranged with respect to the magnetic member.

The place to which the heat generated by the above-described heat transfer means is the vicinity of the discharge path and may be the joint portion of the gas flow path formed in the base with the gas flow path formed by the rotor portion and the stator portion, the vicinity of the rotor portion and the stator portion out of the flow path of gas formed in the base, or the like. The vicinity of the discharge path is like to affect the performance of the vacuum pump, and the flow path is narrow in this area. According to the present invention, it is possible to positively prevent the sublimation of the gas molecular in this portion. It is therefore possible to avoid the damage of the member or the generation of vibration while suppressing the degradation of the performance of the vacuum pump.

In this case, it is preferable that the heat transfer means be provided within the discharge path of gas.

The above-described stator portion and the above-described base or the above-described outer sleeve portion and the base may be formed as the discrete members at the beginning and fixed together later, or formed integrally together from the origin.

In the vacuum pump with the first to fourth structures, at least one of the above-described heating electromagnet, the above-described magnetic member and the above-described heat transfer means may be disposed in the interior of the vacuum pump. Thus, it is possible to directly heat the gas and to utilize the heat generation with a high efficiency.

In order to attain the above-described second embodiment, according to the present invention, in the vacuum pump of the first to fourth structure, there is provided a vacuum pump (fifth structure) in which the heating electromagnet, the magnetic member and the heat transfer means are arranged within an interior of the vacuum pump.

When the heating electromagnet, the magnetic member and the heat transfer means are arranged in the interior of the vacuum pump, it is unnecessary to take a special countermeasure for keeping the safety aspect, and the generated heat hardly leaks to the outside so that the generated heat may be utilized with high efficiency.

The interior of the vacuum pump means the interior of the hollow portion of the outer sleeve portion, the interior of the outer sleeve portion, the surface of the stator portion, the interior of the stator portion, the interior of the rotor portion, the surface of the rotor portion, the surface of the base, and the interior of the base.

In the case where the above-described heating electromagnet and the above-described magnetic member and the heat transfer means are disposed in the interior of the vacuum pump, these components may be disposed on the surface or the interior of the components forming the flow path or the discharge path of the above-described gas as the interior of the vacuum pump. Thus, it is possible to directly heat the gas of the flow path or the discharge path and to utilize the heat generation with a high efficiency.

In the case where the heating electromagnet or the magnetic member and the heat transfer means are disposed on the surface or in the interior of the members constituting the flow path or the discharge path of the gas, it is possible to exemplify the case where, for example, the heating electromagnet or the magnetic member and the heat transfer means are disposed on the surface, facing the rotor, of the stator support member or the surface, facing the spacer, of the rotor support member in the turbo molecular pump provided with the rotor blades as the rotor and the rotor support member (rotor body) for supporting the rotor blades and provided with the stator support member (spacer or the like) for supporting the stator blades as the stator portion. Also, in the screw groove type pump in which the screw groove is formed in the surface, facing the stator, of the rotor portion or the surface, facing the rotor, of the stator portion, the heating electromagnet or the magnetic member and the heat transfer means may be disposed on the surface of the rotor and the stator where the screw groove is formed or the surface facing the surface where this screw groove is formed. Furthermore, it is possible to point out the case where they are disposed in the flow path surface constituting the discharge passage in the base and the interior of the base.

According to the present invention, in any one of the first to fifth structures, there is provided a vacuum pump (sixth aspect), in which a resistance value of the heating electromagnet is not less than 25 Ω.

If the resistance value of the heating electromagnet is not less than 25 Ω, in the case where the electric power of 100 W is fed to the heating electromagnet, the current value $I \leqq 2$ (A). Accordingly, in the case where any non-used pin is provided in the connector terminal of the electromagnet drive cable of the magnetic bearing type vacuum pump, it is possible to utilize this non-used pin. Incidentally, since normally it is unnecessary to flow a large amount of current through the electromagnet drive cable of the magnetic bearing type vacuum pump, the value is 4 (A) at maximum. In view of the guaranteed value, it is preferable that the value is I=2 (A) or less. The resistance value of the heating electromagnet is not less than 25 Ω, so that the non-used pin of the connector terminal may be utilized.

According to the present invention, in any one of the first to sixth structures, there is provided a vacuum pump (seventh aspect), further comprising a temperature sensor for detecting a temperature of a flow path of the discharge path, wherein the control means controls the current supply to the heating electromagnet in response to an output of the temperature sensor.

According to the present invention, in any one of the first to seventh structures, there is provided a vacuum pump (eighth aspect), in which the heating electromagnet is electrically connected to an external power source through a switch, and the switch detects a temperature within the discharge path and interrupts connection between the heating electromagnet and the external power source by thermal expansion when the last mentioned temperature within the discharge path reaches a give temperature.

Such a switch is arranged to function as a control means so that the turning-on/off of the drive of the heating electromagnet may be automatically performed and the discharge path may be kept in a suitable environmental temperature range with a simple structure.

According to the present invention, in any one of the first to eighth structures, there is provided a vacuum pump (ninth aspect), in which the heat transfer means comprises a heat radiation portion formed into fins of the magnetic member or a heat radiation member fixed to the magnetic member made of high heat conductive material.

DETAILED DESCRIPTION OF THE PREFERRED EMBODIMENT

A preferred mode for embodying the invention will now be described in detail with reference to FIGS. 1 to 4.

Figure 1:
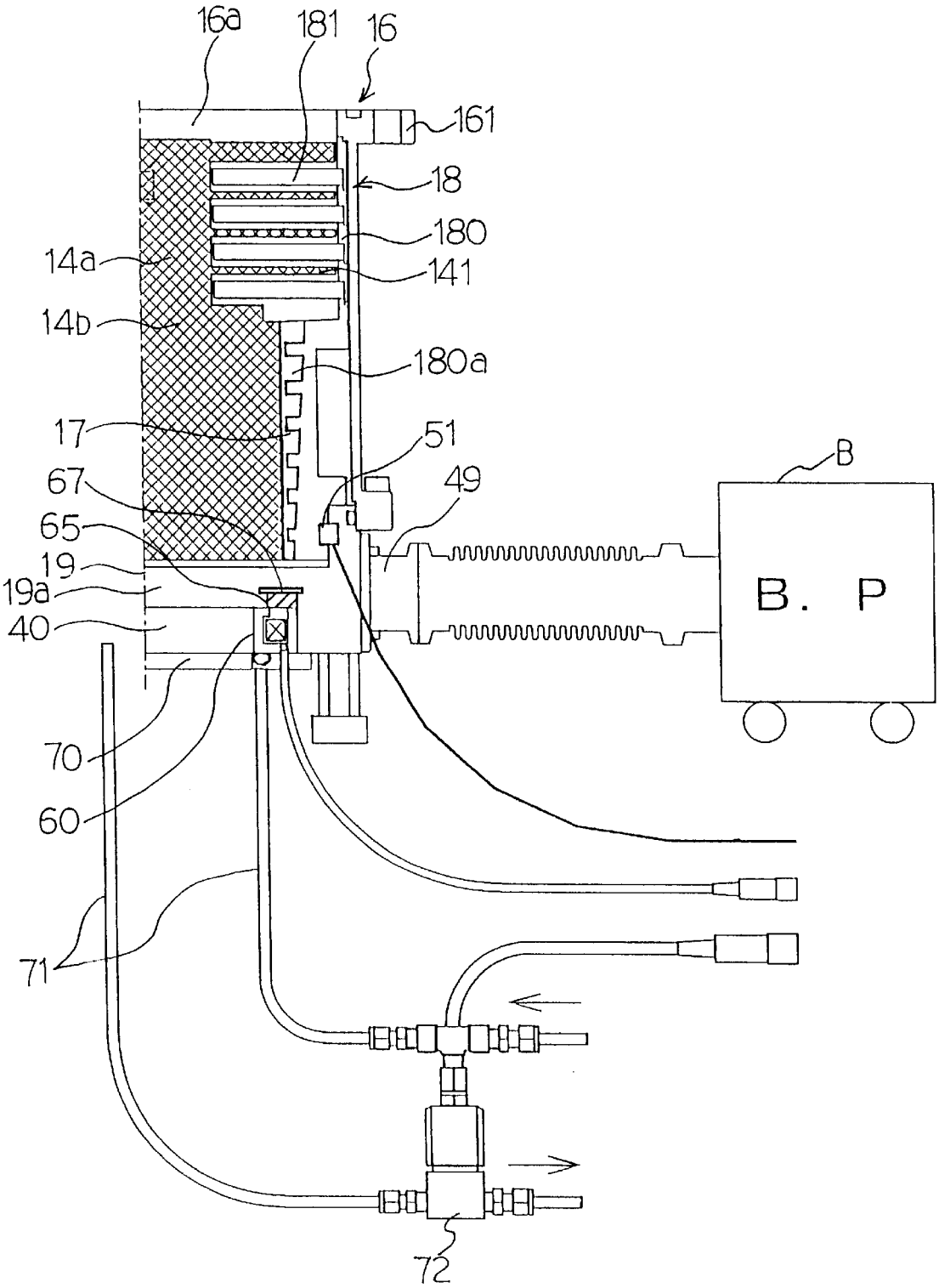
FIG. 1 is a cross-sectional view showing an overall structure of a composite pump in accordance with one embodiment of a vacuum pump of the present invention.

FIG. 1 is a cross-sectional view showing an overall structure of a composite pump in accordance with one embodiment of a vacuum pump of the present invention. Incidentally, in FIG. 1 and other drawings, since the vacuum pump is symmetrical about an axis on its inner side and an outer sleeve, the vacuum pump is shown while the other side has been omitted.

As shown in FIG. 1, the vacuum pump (composite pump) according to the present embodiment is provided with an outer sleeve 16 as an outer sleeve portion having a gas intake port 16*a*, a stator 18 received in a hollow portion of the outer sleeve 16, a rotor 14 received rotatably relative to the stator 18 within the hollow portion of the outer sleeve 16 to form a gas flow path 17 from the intake port 16*a* together with the stator 18, a motor (not shown) for rotating the rotor 14 to move the gas of the flow path 17, and a base 19 having a discharge port 49 for discharging the gas from the outer sleeve 16 to the outside for supporting the outer sleeve 16 and the stator 18.

The hollow portion of the outer sleeve 16 is formed substantially into a cylinder. The outer sleeve has at one circumferential edge portion a flange 161 fixed onto an external container. The other circumferential edge portion is fixed to the base 19. Then, the flange 161 is coupled around the discharge port of the external container so that the interior of the external container and the hollow portion of the outer sleeve 16 are in communication with each other.

The stator 18 is provided with a stator shaft (not shown) fixed coaxially within the hollow portion of the outer sleeve 16, spacers 180, and stator blades 181 supported at their outer circumferential side between these spacers 180.

The stator shaft is in the form of a cylinder. A coil of the motor is fixed to the inner circumferential surface thereof so that a rotational magnetic field rotating about the axis of the stator shaft is formed by the current supply.

The spacers 180 are each in the form of a cylinder having a stepped portion and are laminated on the inner side of the outer sleeve 16.

A screw groove 180*a* is formed on the spacer 180 on the side of the discharge port 49 of the outer sleeve 16, and also, a temperature sensor 51 is fixed for detecting a temperature in the vicinity of the screw groove 180*a*.

The plurality of stator blades 181 are clamped at their circumferential edge portion between the spacers 180 and fixed in the axial direction within the outer sleeve 16 in a plurality of stages. These stator blades 181 have a plurality of stator blade members projecting radially toward the axis of the outer sleeve 16 from the outer circumferential edge portion. These stator blade members are supported at a predetermined slant angle to the circumferential direction.

The rotor 14 is provided with a rotor shaft (not shown) supported rotatably coaxially with the outer sleeve 16 by a magnetic bearing inside the stator shaft, a support portion (not shown) projecting upwardly (outside the intake port 16*a*) of the stator shaft from the rotor shaft, and a rotor body 14*a* supported rotatably together with the rotor shaft outside of the stator shaft by the support portion.

A magnet of the motor is fixed to the outer circumferential surface of the rotor shaft to be faceable with the coil fixed to the circumferential surface within the stator shaft of the stator 18. This magnet is biased by the rotational magnetic field by the coil to thereby rotate the rotor shaft.

The rotor body 14*a* is provided with a sleeve portion 14*b* disposed to surround the stator shaft and rotor blades 141 projecting between the stator blades 181 radially outwardly from the outer circumferential surface of this sleeve portion 14*b*.

An outer diameter on the side of the intake portion 16*a* and an outer diameter on the side of the discharge port 49 of the sleeve portion 14*b* are small and large, respectively. The rotor blades 141 are provided to project from the outer circumferential surface of the portion of the sleeve portion 14*b* where the outer diameter on the intake port 16*a* is small. The portion of the sleeve portion 14*b* where the outer diameter on the side of the discharge port 49 is large is located in the vicinity of the spacers 180 with the screw groove in the outer circumferential surface to face the spacers.

Then, the gas molecular is struck toward the discharge port 49 by the rotor blades 141 on the side of the intake port 16*a*. The gas molecular is moved toward the discharge port 49 by the screw groove 180*a* on the side of the discharge port 49 and is discharged from the discharge port 49 of the base 19.

A flow path (discharge path 19*a*) through which the gas is shifted to the discharge port 49 from between the rotor body 14*a* and the screw groove provided spacer 180 is formed in the base 19. Also, a substrate receiving portion 40 for receiving the substrate for connecting wires from electronic equipment provided in the stator interior or the like is formed in a central portion of the bottom thereof.

Figure 2:
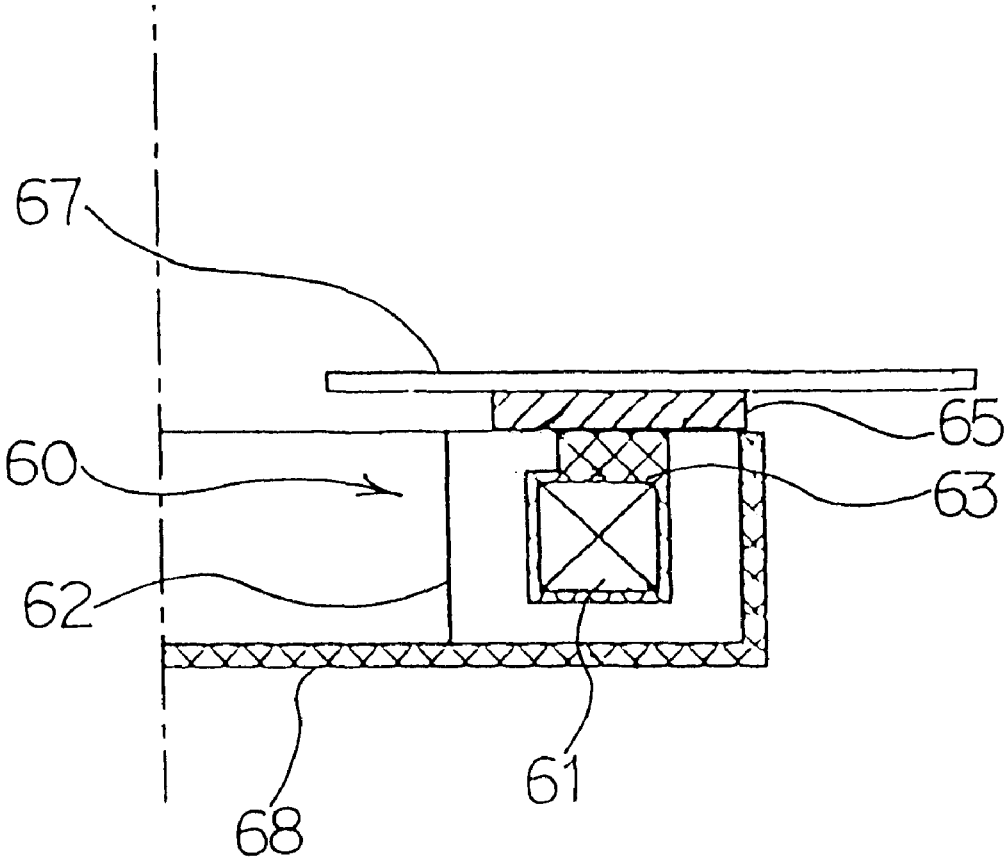
FIG. 2 is an enlarge cross-sectional view of a primary part representing the interior of the base shown in FIG. 1.

FIG. 2 is an enlarge view of a primary part representing the interior of the base according to the present embodiment.

Also as shown in FIG. 2, the base 19 is provided with the heating electromagnet 60 disposed in the vicinity of the discharge path 19*a*, the magnetic member 65 for forming the magnetic path of magnetic force by the heating electromagnet 60 disposed in the vicinity of the discharge path 19*a*, and a heat radiation plate 67 used as a heat transfer means fixed to the magnetic member 65 for transferring the generated heat from the heating electromagnet 60 to the discharge path 19*a*.

The heating electromagnet 60 is provided with a coil 61 wound so as to turn a plurality of times around the substrate receiving portion 40. The current is supplied to this coil 61 to form the magnetic field from the radially outward side of the composite pump toward the inside around the coil 61.

The coil 61 is covered in three directions by a core 62 having a substantially U-shape in cross section with the surface on the stator 18 being opened. The magnetic force by the coil 61 is converged on the core 62. A pair of magnetic poles are formed in the two edge portions on the side of the stator 18 of the core 62. A high heat conductive mold material 63 is filled between the coil 61 and the core 62. This mold material 63 is exposed to the discharge path 19*a* from the open surface of the core 62. In this embodiment, the durable temperature of the mold material 63 is sufficiently higher than the temperature of the heat generated by the coil 61 and is equal to or higher than 200° C.

The outer circumferential surfaces of the core 62 other than the surface on the stator side is covered by the insulating layer 68 that is the heat insulating portion made of heat insulating material. The heating electromagnet 60 is fixed to the base 19 through this insulating layer 68. Incidentally, instead of the heat insulating layer 68, it is possible to form thin support pillars having low heat conductivity and to support the core 62 to the bas 19 by the support pillars.

The magnetic member 67 is fixed to the core 62 so as to cover the open surface of the core 62. The planar heat radiation plate 67 is fixed on the opposite side to the core 62 of this magnetic member 67 and is disposed within the discharge path 19*a*.

A water cooling jacket 70 is fixed to the outside of the substrate receiving portion 40 of the base 19. The cooling water is adapted to be recirculated by cooling water pipes 71 and 71. These water cooling pipes 71 and 71 are adapted to be closed and opened by an electromagnetic valve 72.

Also, in the composite pump according to the present embodiment, as shown in FIG. 1, the back pump B is connected to the discharge port 49 of the base 19. Since the turbo molecular pump or the like could not be operated from the atmospheric pressure, the back pump is indispensable for reducing the discharge port pressure of the main pump down to the constant pressure or less in advance.

Figure 3:
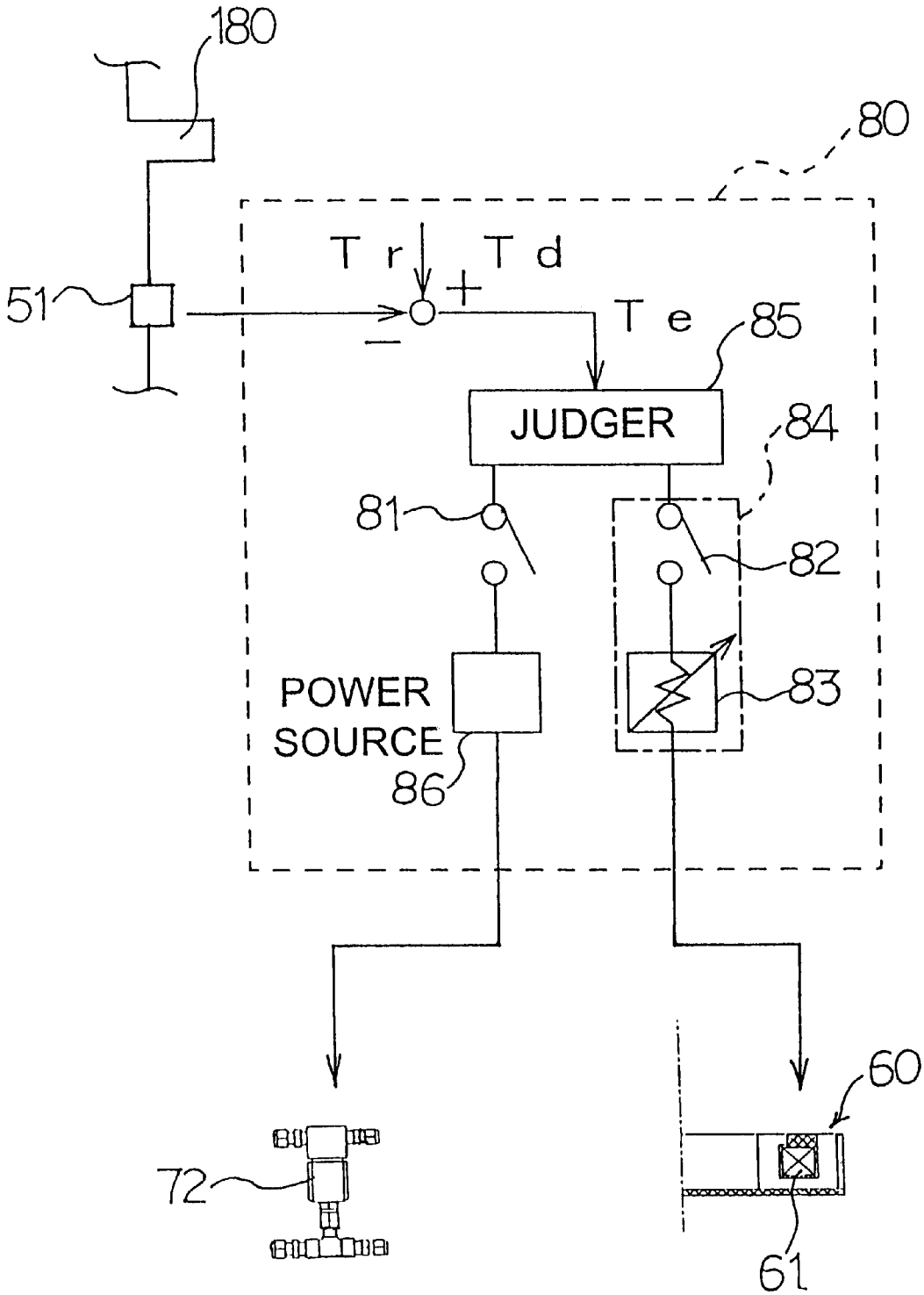
FIG. 3 is a block diagram showing a control portion provided in the composite pump shown in FIG. 1.

FIG. 3 is a block diagram representing a control portion provided in the composite pump according to the present embodiment.

The composite pump according to the present embodiment is provided with the control portion 80 as a control means for controlling the current supply to the coil 61 of the heating electromagnet 60 as shown in FIG. 3 on the outside of the outer sleeve 16. Then, a temperature detecting signal is outputted from the temperature sensor 51 to the control portion 80. The feed of the current to the coil 61 of the heating electromagnet 60 and the feed of current to the electromagnetic valve 72 are controlled in the control portion 80 on the basis of the temperature detecting signal from the temperature sensor 51.

As shown in FIG. 3, the control portion 80 is provided with a power source (valve power source) 86 of the electromagnetic valve 72, a valve switch 81 for turning the valve power source 86 on and off, a current adjuster 84 including an amplifier 83 and a coil switch 82 for turning on and off the current supply to the coil 61 of the heating electromagnet 60 and a judgement means (judger) 85 receiving the temperature detecting signal from the temperature sensor 51 for making a decision as to the switching on and off of the valve switch 81 and the turning on and off of the current adjuster 84, and the magnitude of the current on the basis of the temperature detecting signal.

Then, in this control portion 80, in the judger 85, the detected temperature Tr is sought on the basis of the temperature detecting signal from the temperature sensor 51, and the current fed to the coil 61 through the coil switch 82 and the switching on and off of the valve switch 81 and the coil switch 82 are controlled on the basis of the detected temperature Tr and the set temperature Te set in advance.

In the thus constructed composite pump according to the present embodiment, when the rotor shaft is rotated by the motor, this rotation is transmitted to the rotor body 14*a* and the rotor body 14*a* is rotated at a high speed at a rated value (20,000 to 50,000 rpm). Then, the gas from the intake port 16*a* is shifted through the flow path 17 between the rotor 14 and the stator 18 and discharged from the discharge port 49 in accordance with the rotation of the rotor body 14*a*.

During the rotation of the rotor 14, the temperature detecting signal from the temperature sensor 51 is outputted to the control portion 80.

Then, in the control portion 80, on the basis of the judgement result by the judger 85, in the case where the detected temperature Tr is higher than the set temperature Td (Tr>Td), the valve switch 81 is turned on, and the current from the power source of the electromagnetic valve 72 is fed to the electromagnetic valve 72 to open the electromagnetic valve 72. As a result, the cooling water is fed and recirculated from the cooling water pipe 71 to the jacket 70 to cool down the substrate receiving portion 40 on the central portion of the base 19 or the portion around the stator shaft above the substrate receiving portion 40. The coil switch 82 is turned off so that the current is no longer fed to the coil 61.

Figure 4:
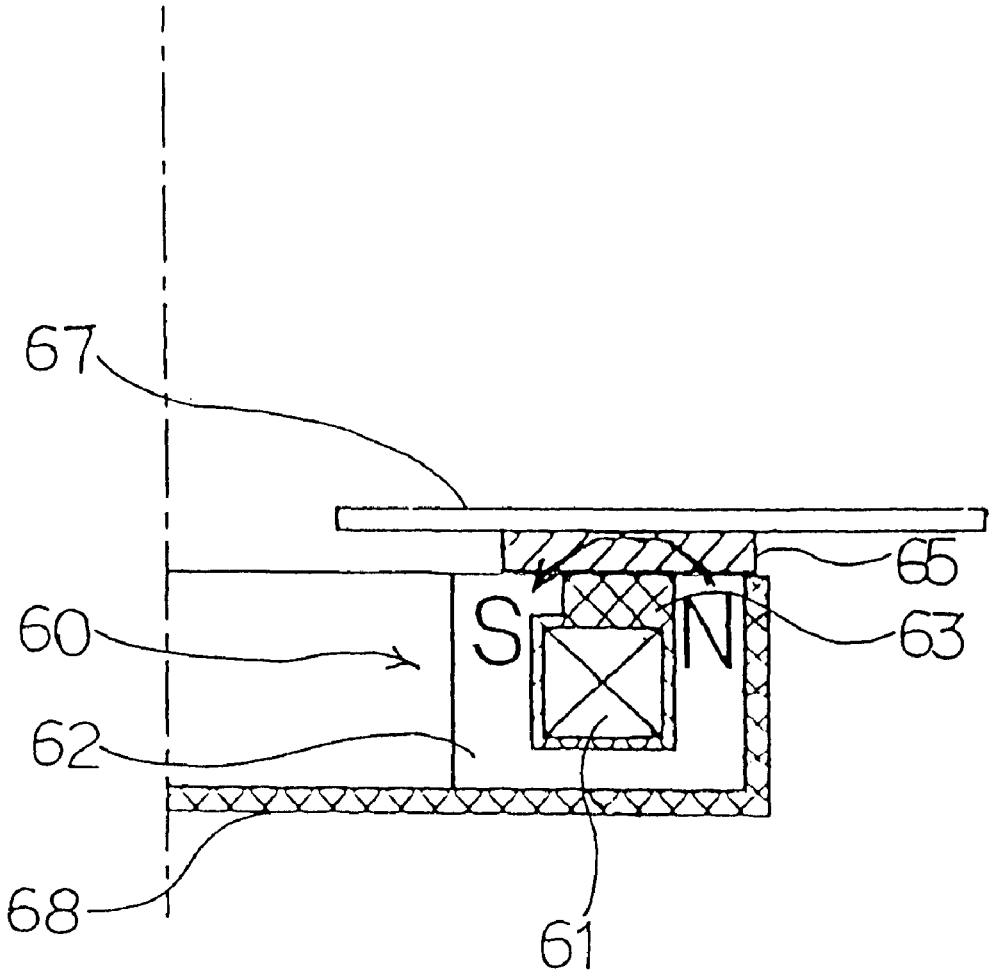
FIG. 4 is a view showing the operation of the composite pump shown in FIG. 1, in the case where the detected temperature is not less than the set temperature.

FIG. 4 is a view showing the state of the composite pump in accordance with the present embodiment in the case where the detected temperature is not higher than the set temperature Td.

In the thus constructed composite pump according to the present embodiment, in the case where the detected temperature Tr is not higher than the set temperature Td (Tr≦Td), the valve switch 81 is turned off not to feed the current to the electromagnetic valve 72 to keep the electromagnetic valve 72 in the closed condition. Also, the coil switch 82 is turned on to feed the current to the heating electromagnet 60.

When the coil switch 82 is turned on, the current to the heating electromagnet 60 is determined in response to the difference Te (Te=Td−Tr) between the set temperature Td and the detected temperature Tr. In the present embodiment, the current signal corresponding to the difference between the set temperature Td and the detected temperature Tr is outputted from the judger 85 and amplified by the amplifier 83 so as to feed the current having the magnitude in proportion to the difference Te to the coil 61. Incidentally, the level of the gain by the amplifier 83 may be changed in response to the difference Te. Also, a limit is provided for the current fed to the coil 61 whereby the service life of the coil is prevented from being shortened due to the eddy current under the condition that the pump is cooled down upon starting.

Then, the coil 61 of the heating electromagnet 60 generates an amount of heat corresponding to the magnitude of the difference Te. The generated heat of the heating electromagnet 60 is effectively transferred to the heat radiation plate 67 through the molded material 63 and the magnetic member 65 and radiated from the heat radiation plate 67 to the discharge path 19*a* so that the discharge path 19*a* is immediately heated.

A pair of magnetic poles are formed in the core 62 by the magnetic force by the coil 61 as shown in FIG. 4. In the present embodiment, an N-pole is formed at an edge portion on the outside of the composite pump and an S-pole is formed at an edge portion of the inside thereof. Then, the magnetic force is adapted to be converged to the magnetic member 65 and introduced into the coil 61.

As a result, there is no fear that the magnetic field of the heating electromagnet surrounds the periphery and there is no fear that the magnetic noise occurs.

Thus, in the composite pump according to the present embodiment, in order to heat the discharge path 19*a,* the heating electromagnet 60 is disposed within the base 19 under the condition thermally insulated from this base 19. The heat is transmitted effectively to the discharge path 19*a* by the heat radiation plate 67 through the magnetic member 65 from the heating electromagnet 60 upon current supply. Accordingly, in the composite pump according to the present embodiment, since the generated heat by the heating source (heating electromagnet 60) is prevented from leaking to the outside and is effectively transmitted to the discharge path 19*a,* it is possible to suppress the electric power to a low level with high thermal efficiency. Then, since the electric power may be suppressed to the low level, the load of the controller power source is low and the thick cable may be dispensed with. For instance, it is possible to apply a pin cable or the like for the magnetic bearing to thereby make it possible to readily reduce the cost. Also, the running cost may be reduced. Also, since the heating source (heating electromagnet 60) is not exposed to the outside, the system is safe, and it is possible to dispense with the countermeasure for the safety aspect. From this stand of view, it is possible to expect the further cost reduction.

In the composite pump according to the present embodiment, since the temperature sensor 51 is provided for detecting the temperature of the gas flow path 17 and the current of the heat electromagnet 60 to the coil 61 is controlled in response to the temperature of the discharge path 19*a* detected by the temperature sensor 51, the discharge path 19*a* and the flow path 17 are heated as desired, to thereby attain further saving of power and the cost reduction.

In the composite pump according to the present embodiment, since the vicinity of the spacer 180 with the screw groove is heated by means of the heat radiation plate 67, the performance of the composite pump is likely to be affected. Also, it is possible to positively prevent the precipitation due to the sublimation of the reactive gas in the screw groove 180*a* where the gas flow path is narrowed. It is possible to effectively to suppress the degradation of performance of the composite pump and at the same time to avoid the contact between the rotor 14 and the stator 18.

In the composite pump according to the present embodiment, since the temperature sensor 51 is provided in the screw groove provided spacer 180 for detecting the temperature in the vicinity of the spacer 180, the performance of the composite pump is likely to be affected. Also, it is possible to positively prevent the precipitation due to the sublimation of the gas molecular in the screw groove 180*a* where the gas flow path is narrowed. It is possible to effectively to suppress the degradation of performance of the composite pump and at the same time to avoid the contact between the rotor 14 and the stator 18.

Incidentally, the turbo molecular pump according to the present invention is not limited to the above-described embodiment but may be suitably changed or modified so far as the modification is not deviated from the heart of the invention.

Figure 5:
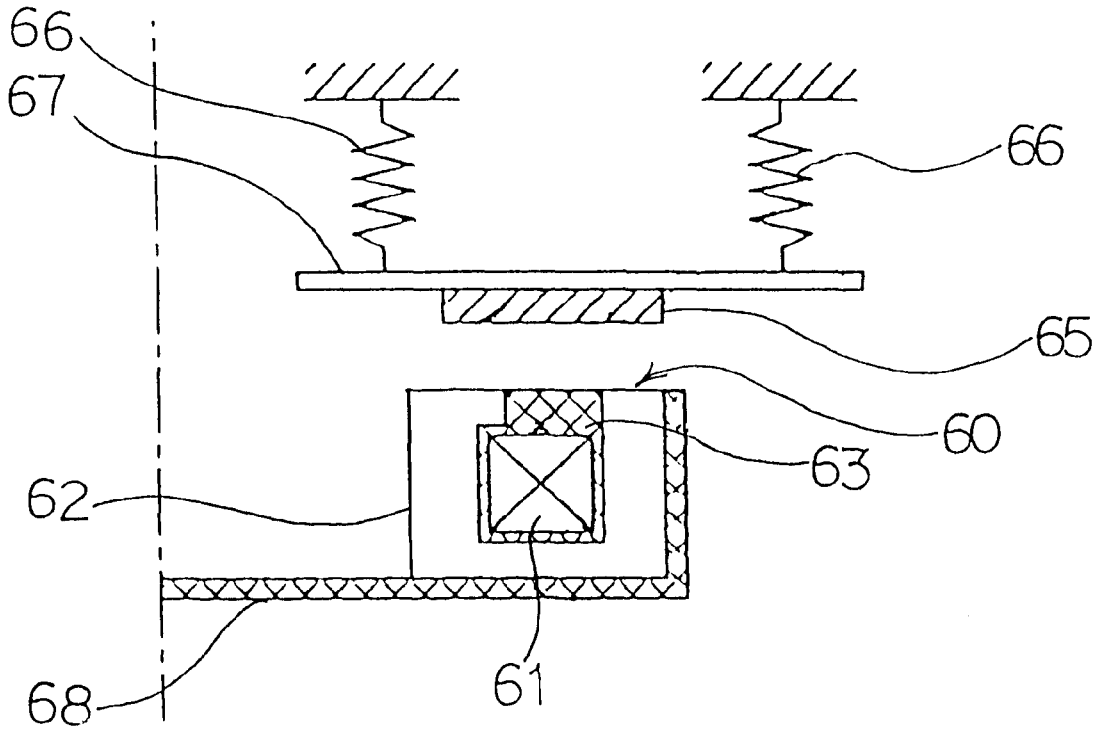
FIG. 5 is a cross-sectional view of a structure of a primary part of another embodiment of the invention.

For instance, in the above-described embodiment, the heating electromagnet and the magnetic member are fixed in place to the stator 18 or the base 49. However, a support means for biasing and supporting one of the above-described heating electromagnet and the above-described magnetic member in the direction retracted away from the other may be provided. For instance, as shown in FIG. 5, it is possible to adapt the arrangement that the heating electromagnet 60 is fixed to the base 49 and the magnetic member 65 and the heat radiation plate 67 are supported to be movable back and forth to the heating electromagnet 60 by the support means such as a tension spring 66 or the like, or the magnetic member 65 and the heat radiation plate 67 are fixed and arranged to the stator 18 or the base 49 and the heating electromagnet is supported to be movable back and forth to the heat transfer means such as the heat radiation plate 67 and the magnetic member 65. In this case, as soon as the drive of the heating electromagnet is stopped, the transmission of the heat is lowered to thereby make it possible to attain the control with high responsibility. Incidentally, the magnetic member may be fixed under the embedded condition in the screw groove provided spacer 180 so that the screw groove provided spacer 180 may function as the heat transfer means. Conventionally, in many cases, the spacer 180 is formed of the material having high conductivity such as aluminum. In such a case, it is therefore possible to utilize the spacer 180 as the heat transfer means. Then, the spacer 180 is used as the heat transfer means so that the spacer 180 may be heated directly by means of the heat electromagnet.

In the above-described embodiments and each modification, the heat radiation plate 67 formed of the high conductive material is fixed to the magnetic member 65 as the heat transfer means. The heat transfer means is not limited to those. It is sufficient to fix and dispose the means to the magnetic member 65 and to transfer the heat generated from the heat electromagnet 60 to the gas flow path 17 downstream and in the direction the shifting direction of the gas. It is possible to use as the heat transfer means the heat radiation portion in which the magnetic member 65 is formed into fins.

In the above-described embodiments and each modification, the heat electromagnet 60 and the magnetic member 65 are arranged in contact with each other. It is possible to arrange the heat electromagnet 60 and the magnetic member 65 to face each other through a gap. In this case, even if the heat electromagnet 60 and the magnetic member 65 may be supported to the same member such as the base 49 or the like or alternatively may be supported to different members like the case where one is supported to the base 49 and the other is supported to the stator 18.

In the above-described embodiments and each modification, the heat radiation member formed in plates of high conductive material is used as the heat transfer means. However, the heat radiation means is formed into fins that may radiate heat and disposed in the interior of the discharge path 19*a* to make it possible to enhance the heat radiation efficiency to the discharge path 19*a* and to heat the discharge path 19*a* with much higher efficiency.

Figure 6:
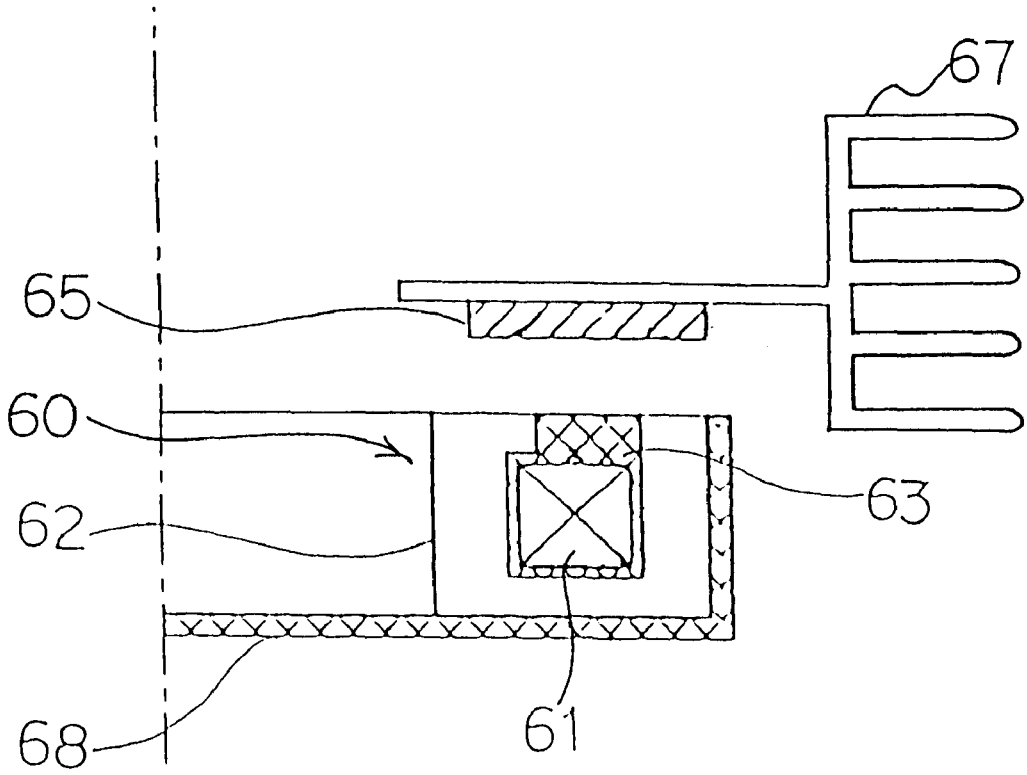
FIG. 6 is a cross-sectional view of a structure of a primary part of another embodiment of the invention.

FIG. 6 shows an example in which the heating electromagnet 60 and the magnetic member 65 are caused to face each other through the gap and the heat radiation member is formed into fins.

Figure 7:
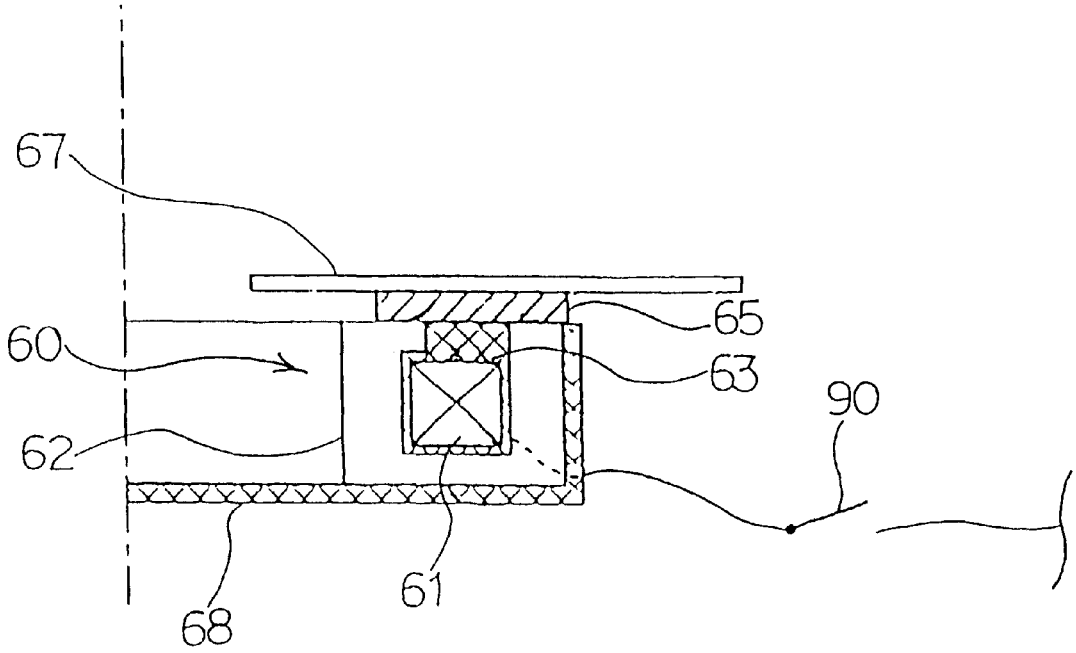
FIG. 7 is a cross-sectional view of a structure of a primary part of another embodiment of the invention.

In the above-described embodiments and each modification, the current of the heating electromagnet 60 to the coil 61 is controlled by means of the control portion 80 in response to the temperature of the discharge path 19*a* detected by the temperature sensor 51. However, in the example shown in FIG. 7, a switch may be interposed and arranged between the heating electromagnet 60 and the external power source, and this switch may sense the temperature of the interior of the discharge path 19*a* and interrupt the connection between the external power source and the heating electromagnet 60 by the thermal expansion over a predetermined temperature. One formed of a bimetal may be used as this switch. Incidentally, in the modification shown in FIG. 7, the planar bimetal is used but it is possible to take a spiral shape, a wound shape, an arcuate shape or the like for the bimetal.

Figure 8:
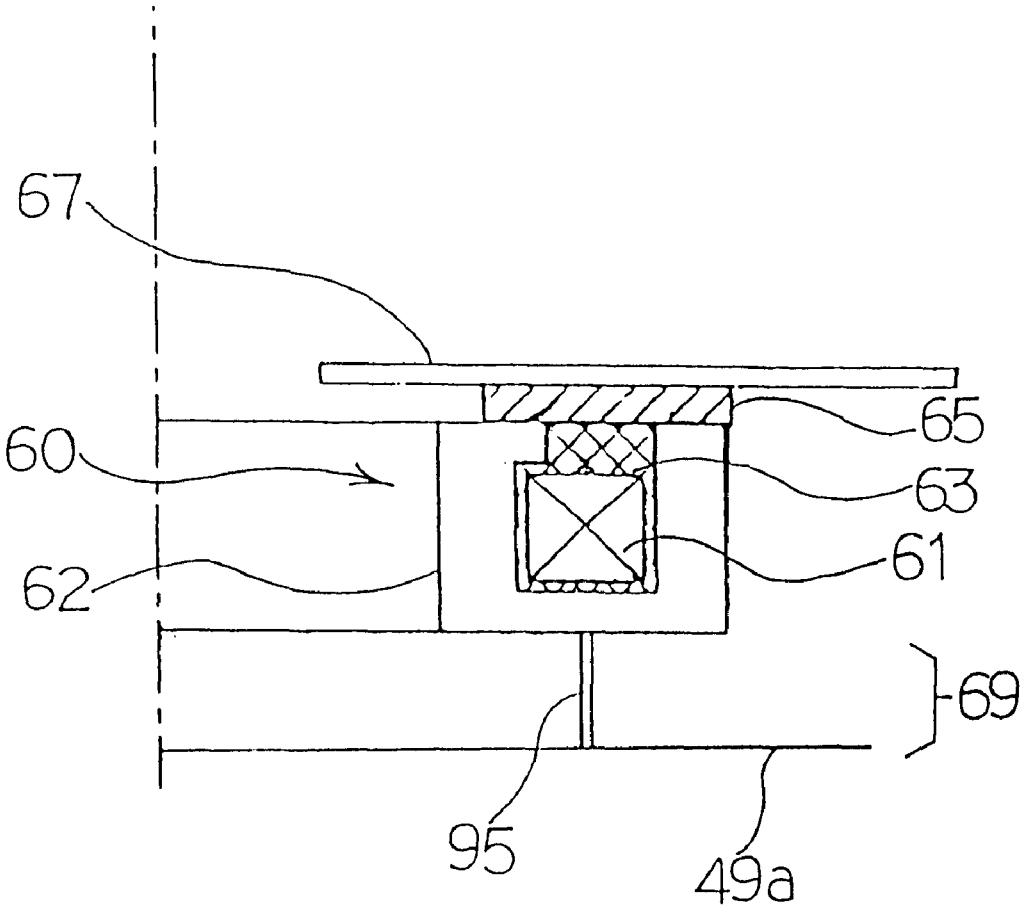
FIG. 8 is a cross-sectional view of a structure of a primary part of another embodiment of the invention.
Figure 9:
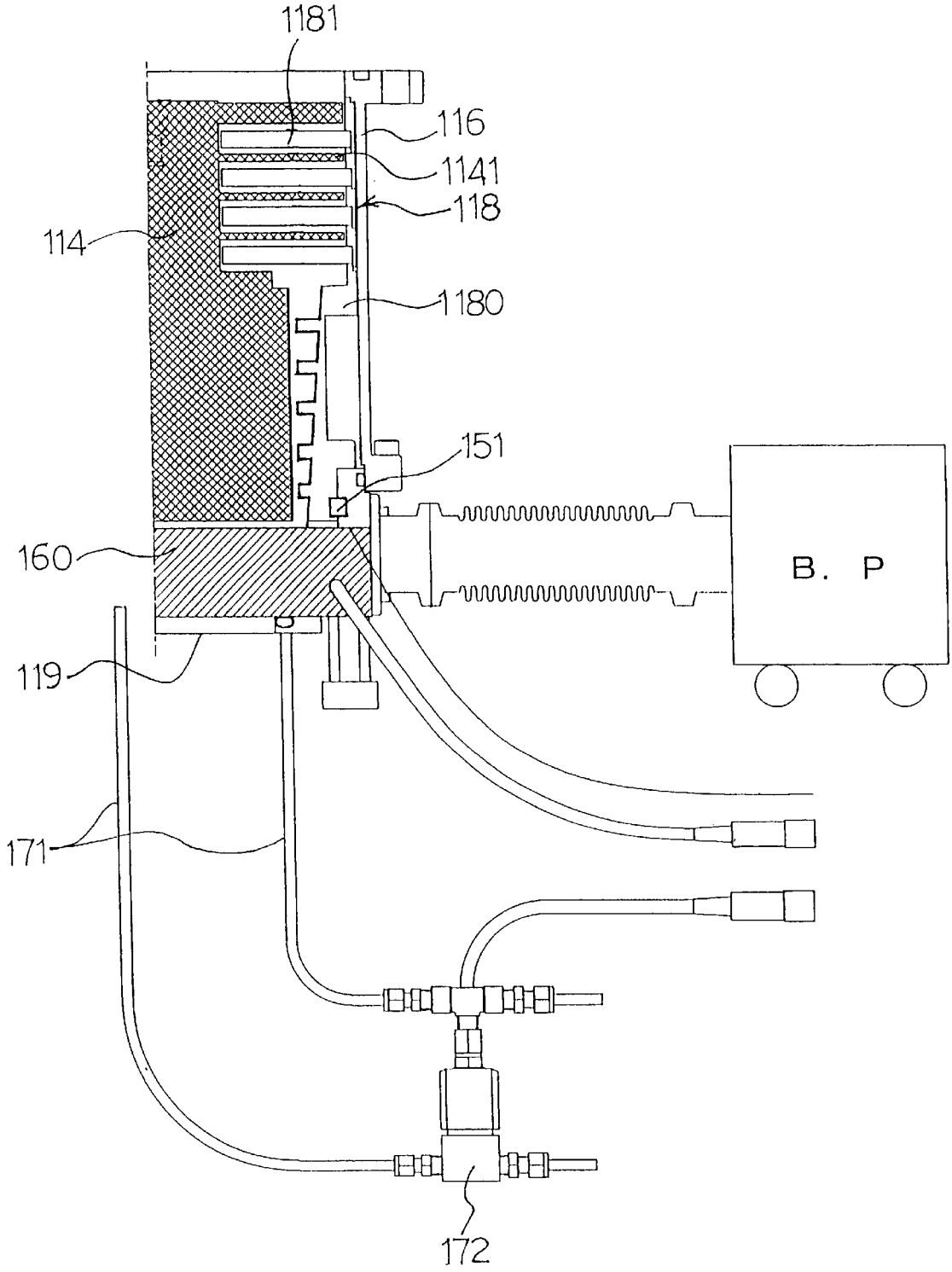
FIG. 9 is a cross-sectional view showing an overall structure of a conventional vacuum pump.
Figure 10:
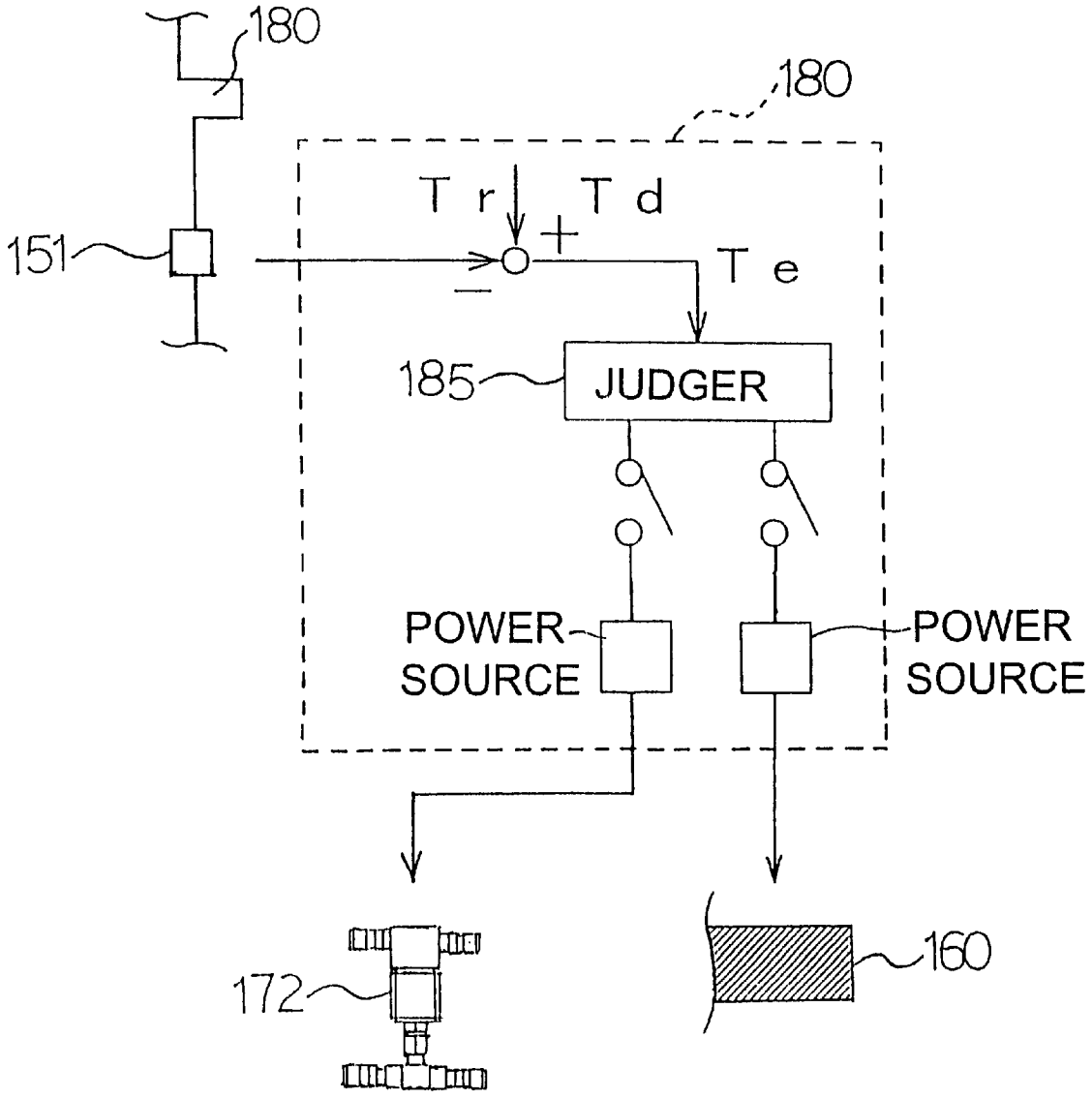
FIG. 10 is a block diagram representing the control portion provided in the conventional vacuum pump.

In the above-described embodiments and each modification, the heat insulating layer 68 made of heat insulating material is provided to cover the core 62. However, as shown in FIG. 8, in the heat insulating portion, the core 62 is supported to the member 49*a* of the base 49 by the support pillar 95 formed of the material having a low heat conductivity, and a gap is formed between the base 49 and the core 62 in the portion other than the support pillar 95 to make the heat insulating portion 69.

In the above-described embodiments and each modification, the rotor blades 141 project from the outer circumferential surface to the outside of the sleeve portion 14*b*. However, it is possible to prove the rotor blades projecting inwardly from the inner circumferential surface of the sleeve portion 14*b* and to dispose the spacers 180 of the stator 18 and the stator blades 181 inside the sleeve portion 14*b*.

In the above-described embodiments and each modification, the screw groove 180*a* is formed on the side facing the rotor 14 of the stator 18 (spacers 180). However, in the vacuum pump where the screw groove is formed also on the side of the surface facing the stator of the rotor 14 such as the sleeve portion 14*b*, the same mechanism may be provided in the same manner on this side and may work effectively.

In the above-described embodiments and each modification, the vacuum pump is provided with a composite turbo molecular pump provided both the rotor blades 141 and stator blades 181, and provided with the turbo molecular pump portion and a composite turbo molecular pump and the screw pump portion where the rotor portion 14 portion is rotated to shift the gas while utilizing the viscosity of the gas. However, it is possible to take the screw groove type pump for sucking the gas only by the screw groove type pump portion or the turbo molecular pump for sucking the gas only by the turbo molecular pump portion.

As described above, according to the present invention, it is possible to provide a less expensive pump that may avoid the precipitation of the gas molecular composition in a flow path of gas by heating the flow path of gas effectively with a small electric power and to provide a vacuum pump that is superior in handing property and safety aspect.

What is claimed is:

1. A vacuum pump comprising:

an outer sleeve portion;

a stator portion received in a hollow portion of the outer sleeve portion;

a rotor portion received rotatably relative to the stator portion within the hollow portion of the outer sleeve portion for forming a flow path of gas in cooperation with the stator portion;

a motor for rotating the rotor portion and for moving the gas within the flow path;

a base portion having a discharge path for discharging the gas from the flow path to the outside, for supporting the stator portion;

a heating electromagnet arranged in the vicinity of the discharge path;

a magnetic member for forming a magnetic path of magnetic force by the heating electromagnet arranged in the vicinity of the discharge path; and a control means for controlling current supply to the heating electromagnet.

2. The vacuum pump according to claim 1, wherein the heating magnet and the magnetic member face each other through a gap.

3. The vacuum pump according to claim 1, wherein the heating electromagnet is fixed to one of the base portion and the stator portion through a heat insulating portion for reducing heat conduction between the heating electromagnet and the one.

4. The vacuum pump according to claim 1, wherein a heat transfer means for transferring heat generated from the heating electromagnet to the discharge path.

5. The vacuum pump according to claim 1, wherein the heating electromagnet, the magnetic member and the heat transfer means are arranged within an interior of the vacuum pump.

6. The vacuum pump according to claim 1, wherein a resistance value of the heating electromagnet is not less than 25 Ω.

7. The vacuum pump according to claim 1, characterized by further comprising a temperature sensor for detecting a temperature of a flow path of the discharge path and in that the control means controls the current supply to the heating electromagnet in response to an output of the temperature senor.

8. The vacuum pump according to claim 1, wherein the heating electromagnet is electrically connected to an external power source through a switch, and the switch detects a temperature within the discharge path and interrupts connection between the heating electromagnet and the external power source by thermal expansion when the last mentioned temperature within the discharge path reaches a given temperature.

9. The vacuum pump according to claim 1, wherein the heat transfer means comprises a heat radiation portion formed into fins of the magnetic member or a heat radiation member fixed to the magnetic member made of high heat conductive material.

* * * * *